United States Patent [19]

Liebel

[11] Patent Number: 4,890,787

[45] Date of Patent: Jan. 2, 1990

[54] SHIPPING CONTAINER

[75] Inventor: Henry L. Liebel, Cincinnati, Ohio

[73] Assignee: Shippers Paper Products Company, Loveland, Ohio

[21] Appl. No.: 258,461

[22] Filed: Oct. 17, 1988

[51] Int. Cl.[4] ..... B65D 6/10

[52] U.S. Cl. ..... 229/23 BT; 229/23 R; 229/199; 229/120.22; 229/120.38; 220/441; 220/71

[58] Field of Search ..... 229/120.22, 120.38, 229/199, 23 R, 41 R, 23 BT; 220/441, 468, 71

[56] References Cited

U.S. PATENT DOCUMENTS

| | | | |
|---|---|---|---|
| 140,736 | 7/1873 | Snow | 229/23 R |
| 2,620,119 | 12/1952 | George | 229/23 R |
| 4,729,505 | 3/1988 | Remaks et al. | 229/23 R |
| 4,742,951 | 5/1988 | Kelly et al. | 229/23 R |

FOREIGN PATENT DOCUMENTS

| | | | |
|---|---|---|---|
| 0703631 | 2/1965 | Canada | 220/441 |

*Primary Examiner*—Stephen Marcus
*Assistant Examiner*—Kathryn M. Stemann
*Attorney, Agent, or Firm*—Wood, Herron & Evans

[57] ABSTRACT

A shipping container for shipping bulk loads of pelletized, granular, powdered or other particulate material including an outer corrugated box and an inner cylindrical paper cylinder extending to the inner walls of the box. The container is characterized by its significantly increased resistance to outward bulging of the side walls by the weight of the material contained therein.

3 Claims, 2 Drawing Sheets

SHIPPING CONTAINER

BACKGROUND OF THE INVENTION

This invention relates to an improved shipping container and, more particularly, to an improved shipping container such as a corrugated shipping container for transporting bulk loads of material in pelletized, granular, powdered or other particulate form.

In the transport of bulk materials in pelletized, granular, powdered or other particulate form, such as in the shipping of plastics and resins in pelletized form for melting and molding; powdered metals, for pressing and sintering; and the like, such materials are typically shipped in a shipping container having side walls formed, for example, of corrugated cardboard. One such container, which is sometimes referred to as a Gaylord, comprises a cardboard tube formed of four corrugated side walls and caps which fit on either end of the tube to form an enclosed container. Material to be shipped such as pellets, powder, granulate, or other particulate material is introduced into the tube which sits inside of a bottom cap. A plastic bag may be inserted in the tube to contain the material to protect the material from moisture. Once the container is full, the top cap is placed on the tube and the container securely closed, for example, by metal or plastic straps extending thereabout. One of the problems encountered as the shipping container becomes larger and larger in order to ship more and more material is that the side walls of the container bulge outwardly under the weight of the material contained therein. To eliminate this bulging, manufacturers have resorted to increasing the thickness of the corrugated side walls to thereby increase their strength and their resistance to bulging. This, however, results in increased weight of the container and increased cost without eliminating the problem of outward bulging. Another solution has been to change the material of construction from corrugated paperboard to plywood in an attempt again to increase the strength of the container. Again, the weight and cost of the container are likewise significantly increased.

SUMMARY OF THE INVENTION

The present invention contemplates a new construction to provide a shipping container for pelletized, granular, powdered, or other particulate materials which has a significantly increased resistance to bulging under the weight of the material contained in the container. In a presently preferred form of the invention, the container comprises an outer tube formed of four corrugated paperboard side walls and an inner tube which is formed in the shape of a cylinder open at both ends. The diameter of the inner cylinder is equal to the width of at least two of the side walls such that the cylinder extends generally to at least two of the side walls. The inner cylinder may be constructed out of laminated kraft paper of two or three plys and having a thickness from about 0.016 inches to 0.060 inches which is formed into the shape of an open-ended cylinder and glued to itself along an overlapping seam. Alternative materials to kraft paper may be used to form the inner cylinder such as oriented polyester, polypropylene, polyethylene, or a spun-bonded polymer. The height of the tube may vary as preferred in application. In one form, the tube has a height generally equal to the height of the corrugated side walls. Feet may be provided at the base thereof for supporting the cylinder in the container. The container is designed such that the material being shipped fills the interior of the inner cylinder and also the corner areas between the outer wall of the inner cylinder and the side walls. To this end, holes may be placed in the cylinder to allow material to flow out of the cylinder to fill these open areas. Likewise, the height of the tube may be less than the height of the side walls such that material introduced into the cylinder spills over the top thereof to fill the open areas. Still further, the tube also may be secured to the side walls, such as by gluing, and terminate two or three inches up from the bottom of the container to allow material to flow out and into the open areas. This latter construction also is particularly advantageous in applications where the container is to be emptied by tipping it toward one corner and sucking the material out. The fact that the cylinder terminates two or three inches from the bottom of the container permits material to flow thereby to the low corner without obstruction.

In a still further embodiment of the invention, the cylinder may be glued to two sides of the side wall such that in the knockdown condition of the container with the container flattened, the tube is likewise flattened. This permits the container to be stacked and shipped in a flat condition saving substantially on shipping space. However, when the container is erected, the inner tube immediately takes its cylindrical configuration.

It has been found surprisingly that the container construction of the present invention, comprising in effect a tube within a tube, has a significantly increased resistance to outward bulging due to the weight of the material contained therein.

DETAILED DESCRIPTION OF THE INVENTION

Figure 1:
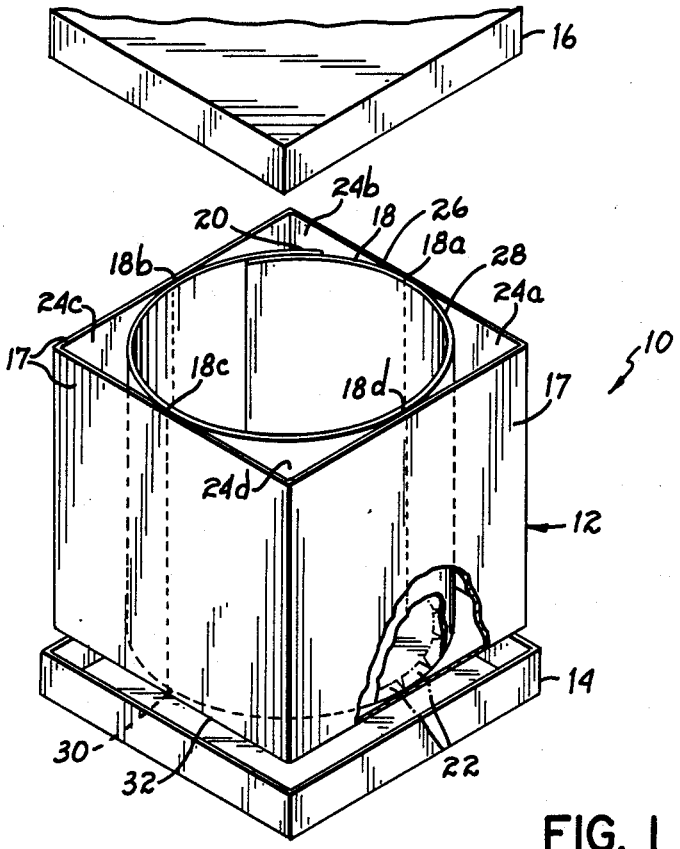
FIG. 1 is an exploded isometric view with parts broken away of one embodiment of the present invention.

Referring now to FIG. 1, the shipping container 10 of the present invention includes an outer tube 12, a bottom cap 14, and a top cap 16. The outer tube 12 is formed with four sides 17 of a suitable container material such as single, double, or triple-wall corrugated paperboard. A typical construction comprises four equi-dimensioned side walls 17 48 inches wide by 48 inches high. However, the height of the tube 12 can be other dimensions, for example, 36 inches, 40 inches, and typically up to 60 inches. Likewise, the widths of the side walls 17 may also be of different dimensions. A common container size has two opposed side walls 40 inches wide and two opposed side walls 48 inches wide.

Within the side walls 17 of the container 10 is an open-ended cylindrical tube 18. As shown in the embodiment illustrated in FIGS. 1–4, the side walls 17 have equal widths and the cylindrical tube 18 has a diameter equalling generally the width of the side walls 17 of the container 10 such that the tube 18 extends to and may abut against the side walls of the box 10 from top to bottom at four spaced locations 18*a, b, c, d.* However, in other containers having opposed pairs of side walls of different widths, the inner tube 18 will have a diameter generally equal to the shorter width and extend to only one pair of the side walls 17. Although not as effective as when the side walls 17 are of equal widths, bulging of the side walls 17 can still be reduced in accordance with the principles of this invention.

In one embodiment of the invention, the inner tube 18 is formed of laminated kraft paper of two or three plys and has a thickness in the range of 0.016 inches to 0.060 inches. The inner tube 18 has a relatively wide overlap 20, for example, about one foot, where it is glued together by a suitable adhesive, such as a polyvinyl acetate. The relatively wide glued overlap is for purposes of insuring the strength of the inner tube 18. The inner tube 18 may be formed of one sheet overlapped and glued together, as shown in FIG. 1, or the sheet may be wrapped around itself one or more times to give a multiwall effect. The grain direction of the inner tube 18 is oriented in its circumferential direction to give the inner tube 18 its greatest strength in the circumferential direction. Other material such as an oriented polyester, polypropylene, polyethylene, or a spun-bonded polymer may be used in place of laminated kraft paper.

As shown in FIG. 1, the bottom two or three inches of the inner tube 18 are die cut to permit its folding inward to form a number of feet 22 which support the inner tube 18 within the outer tube 12. However, it will be recognized that this construction is only one of several alternatives.

In application, the container 10 is enclosed at its base, for example, by setting it in the bottom cap 14 which may be formed of like corrugated material. The container 10 is then filled by introducing the material to be transported, such as pelletized, granular, or powdered material, inside of the inner tube 18. The open areas 24*a–d* between the outside wall of the tube 18 and the corners of the tube 12 are likewise filled with material which may be accomplished by filling these areas after filing of the inner tube 18. Alternatively, holes (not shown) may be placed in the wall of the inner tube 18 to permit material in the inner tube 18 to flow outwardly to fill the corner areas 24*a–d*. As set forth above, it has been found surprisingly with this construction that the resistance to bulging of the side walls 17 of the container is significantly increased.

In some applications, it is desirable to enclose the material being shipped in a plastic bag to insulate it from moisture. In such applications, the outer tube 12 would be placed in the bottom cap 14, and the plastic bag (not shown) placed in the outer tube 12. The inner tube 18 then would be inserted in the plastic bag and the container filled including the corner areas 24*a–d*.

Figure 2:
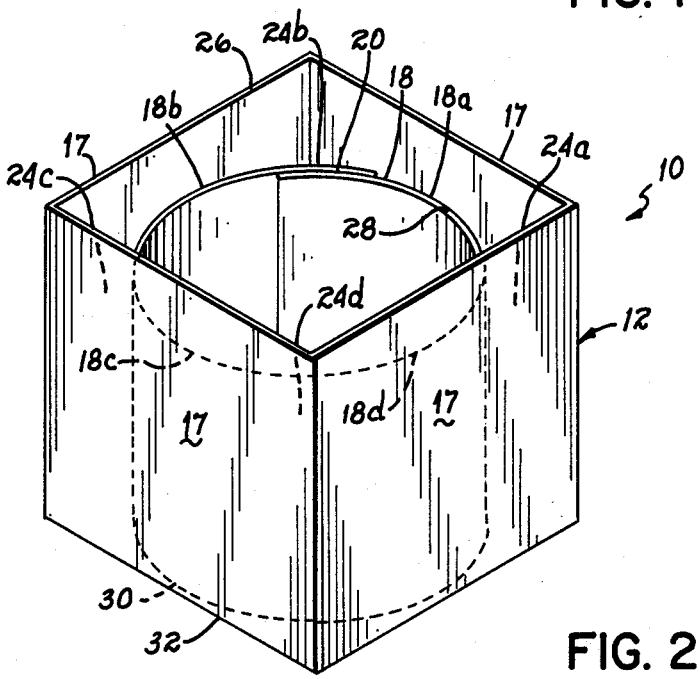
FIG. 2 is an isometric schematic of a second embodiment of the present invention.

Referring to FIG. 2, the material to be transported may be caused to be introduced into the open corner areas 24*a–d* of the container 10 simply by terminating the height of the inner tube 18 two or three inches from the top 26 of the outer tube 12. In this manner once the inner tube 18 is filled, the material overflows the top 28 thereof and fills the corner areas 24*a–d*. Although the inner tube 18 does not extend the entire height of the container 10 and the material is free to flow over top 28 to fill the container 10, it has been found that this construction still does not result in bulging of the side walls of the container.

In any of the embodiments described herein, the inner tube 18 may be secured to one or more of the side walls 17 of the container 10 by a vertical glue line along the area of contact, e.g., lines of contact, 18*a–d* (FIG. 1) of the inner tube 18 with the container side walls 17. This may be done at the point of manufacture of the container 10.

Figure 3:
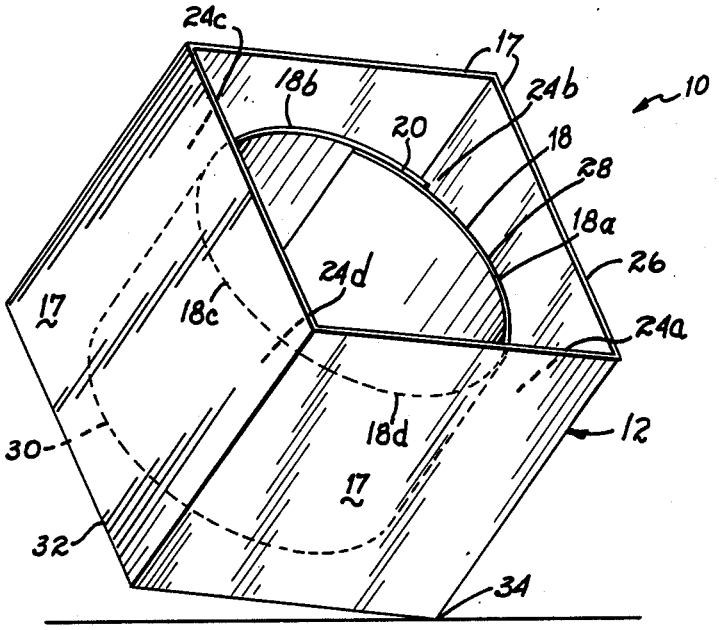
FIG. 3 is an isometric schematic of another embodiment of the invention with the container tipped toward one corner.

Referring now to FIG. 3, in this embodiment of the invention, the inner tube 18 is of a height which allows it to be placed in the container 10 and glued to the side walls 17 along the lines of contact therebetween 18*a–d* with two or three inches being left between the top 28 and the bottom 30 of the inner tube 18 and the top 26 and bottom 32 of the outer tube 12, respectively. In a number of applications, the particulate material transported in the container 10 is removed by placing a suction hose (not shown) at one of the corners 24*a–d* and sucking the material out by reduced air pressure. In such applications, the container 10 is tipped to one corner 34 to allow material to flow toward that corner 34 for complete emptying of the container. Were the inner tube 18 to extend all the way to the base 32 of the outer tube 12, the inner tube 18 would itself be an obstruction to flow of the particulate material to the low corner 34. However, with the inner tube 18 terminating two or three inches short of the container bottom 32, material may flow freely to the one corner 34.

Figure 4:
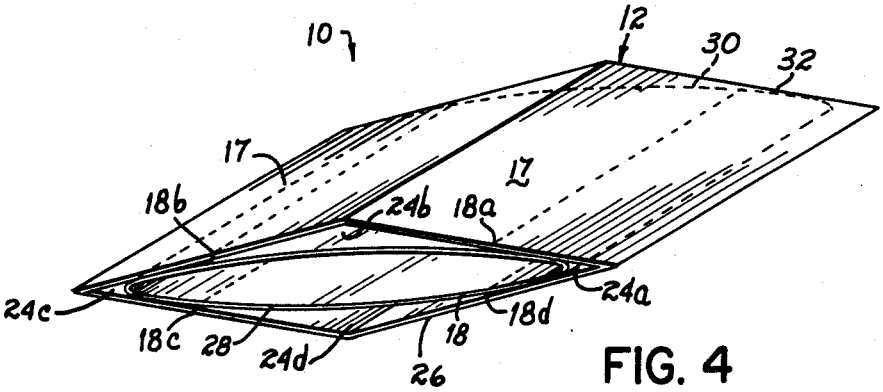
FIG. 4 is an isometric schematic illustrating the container in a knockdown condition.

Another advantage of the present invention is the ability to ship the container in a flat, knockdown condition. In such construction as shown in FIG. 4, the inner tube 18 is placed in the outer tube 12 and secured along glue lines to the inside of two sides 17 thereof. The inner tube 18 being formed of kraft or other foldable material may be folded along with the outer tube 12 to permit shipping of the container in a flat condition. Once the container is erected as the outward corners of the outer tube 12 are brought together, however, the inner tube 18 forms into its cylindrical configuration shown in FIG. 1.

Although this invention has been described with reference to particular materials of construction, it will be recognized that other forms may be used. For example, the outer carton construction could be a regular slotted carton. Also, the walls of the outer tube 12 could be formed of solid fiber paperboard instead of corrugated.

Thus having described the invention, what is claimed is:

1. A shipping container for transporting particulate material comprising:

a four-sided outer paper tube having generally rectangular sides; and generally cylindrical inner tube means within said outer paper tube having a diameter generally equal to the width separating at least a pair of sides of said outer paper tube and being adapted to extend toward the said pair of sides of said outer paper tube and defining areas for receiving said particulate material to be contained including the interior of said inner tube means and the areas between said inner tube means and said sides of said outer paper tube for resisting bulging of said container by the weight of the particular material to be contained therein;

said inner tube means being adhererd to the said pair of sides of said outer paper tube, said outer paper tube and said inner tube means being foldable to a knockdown position to be stacked and shipped in a substantially flat condition and then to be erected for use.

2. The container of claim 1 wherein said sides are of substantially equal width and said inner tube means extends toward each of the sides of said outer paper tube.

3. A shipping container for transporting particulate material comprising:

a four-sided outer tube, the sides thereof being rectangular and being formed of corrugated paperboard;

inner cylindrical tube means within said four-sided outer tube having a diameter generally equal to the width of at least a pair of the sides of said four-sided outer tube and being adhered to at least one of the sides of said four-sided outer tube and defining areas for receiving particulate material including the interior of said inner cylindrical tube means and the corners between said inner cylindrical tube means and said sides of said four-sided outer tube for resisting bulging of said container by the weight of the particulate material to be contained therein.

* * * * *